US007159867B2

(12) United States Patent
Huley

(10) Patent No.: US 7,159,867 B2
(45) Date of Patent: Jan. 9, 2007

(54) SPORTS RELATED BOARD GAME

(76) Inventor: Lawrence Huley, 1035 Riviera Dr., Pasadena, CA (US) 91107

( * ) Notice: Subject to any disclaimer, the term of this patent is extended or adjusted under 35 U.S.C. 154(b) by 212 days.

(21) Appl. No.: 10/259,991

(22) Filed: Sep. 27, 2002

(65) Prior Publication Data

US 2004/0080108 A1 Apr. 29, 2004

(51) Int. Cl.
*A63F 3/00* (2006.01)

(52) U.S. Cl. ..... 273/259; 273/247

(58) Field of Classification Search ..... 273/244, 273/244.1, 244.2, 247, 259, 277
See application file for complete search history.

(56) References Cited

U.S. PATENT DOCUMENTS 3,827,691 A * 8/1974 Benander ..... 273/108.5
4,010,957 A * 3/1977 Tricoli ..... 273/256
4,486,022 A * 12/1984 Dixon ..... 273/256
5,163,687 A * 11/1992 Jenkins ..... 273/277

OTHER PUBLICATIONS

Ex.Parte Breslow 192 USPQ 431.*

* cited by examiner

*Primary Examiner*—Vishu Mendiratta
(74) *Attorney, Agent, or Firm*—Sonnenschein Nath & Rosenthal LLP

(57) ABSTRACT

A board game comprising a game board representative of a sport playing field having a plurality of spaces. The board game includes a first set of tokens to be deployed on the game board representing a first team of sport players; a second set of tokens to be deployed on the game board representing a second team of sport players; a random number generator; and a predetermined amount of game currency. The board game further includes a set of player cards, each one of the set of player cards representing characteristics of a sport player including a dollar amount to be received by an owner of the sport player in response to the player scoring.

6 Claims, 8 Drawing Sheets

SPORTS RELATED BOARD GAME

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates to sports board games and methods of playing a sports related board game.

BACKGROUND OF THE INVENTION

Sports related board games, and specifically, basketball board games, are typically centered around the basketball game where the purpose of the board game is to score the most points and beat the opposing team. Thus, prior basketball board games have put the player in the shoes of either a coach or a basketball player on the court.

The present invention, on the other hand, is a basketball board game that allows a player to act as the owner of a basketball franchise, where the object is to become the wealthiest owner at the end of the game. The game allows the player, acting as the franchise owner, to purchase different basketball players with varying characteristics and to accumulate money based on the performance of the individual basketball players and the team. The game also allows the player to handle all the money and take care of all business involved with owning a basketball team, such as collecting money for the Gate Receipts, Parking Lot Receipts, Snack Bar Profit, Fan Appreciation Night, and Souvenir Stands.

DETAILED DESCRIPTION

The present invention is a sports business board game that functions around simulated game play. The game is played by two players, or two teams each being played by multiple players. Each player acts as an owner of a sports team (e.g. Basketball, Soccer, Baseball, Football, etc.), where the object of the game is not to score the most points, but to accumulate the most wealth.

The basketball board game may include a game board 10 a bank, two sets of Player Contract Cards 30 and 32, one set of Business Decision Cards 34, one set of Great Play Cards 36, one Score Sheet Pad, Player Chips 24 and 26; one brown chip 28 representing the ball; and currency 38 in various denominations. The game also includes a random number generator such as dice, a spinner, or a deck of cards with a different number on each card. For the purposes of this description, the game will be described in the context of a basketball game using a pair of dice 40.

Figure 1:
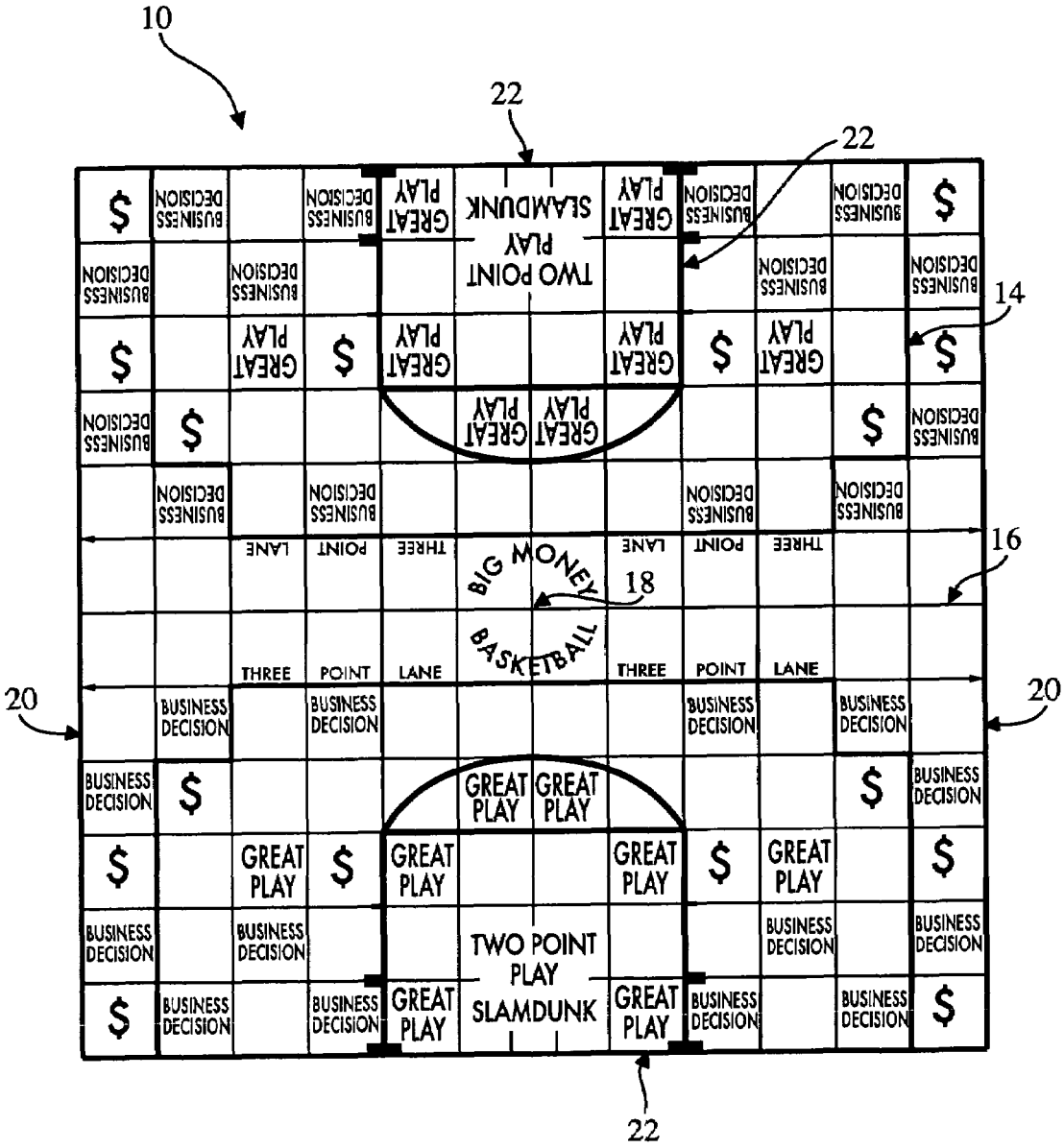
FIG. 1 is a top view of one embodiment of a game board according to the present invention.

FIG. 1 is one embodiment of a game board 10 to be used with the present invention. The game board 10 is representative of a basketball court and includes typical court markings such as a free throw lane 12, a three point line 14, a half court line 16, a jump ball area 18 out of bounds sidelines 20, and out of bounds end lines 22. The preferred game board is arranged as an array of square spaces having twelve rows and twelve columns, however fewer and greater number of columns and rows may be used. Each space on the game board also does not have to be of a uniform size. The spaces may include a plurality of Situation Spots, marked with indicia such as "$", "Business Decision", or "Great Play."

Figure 2:
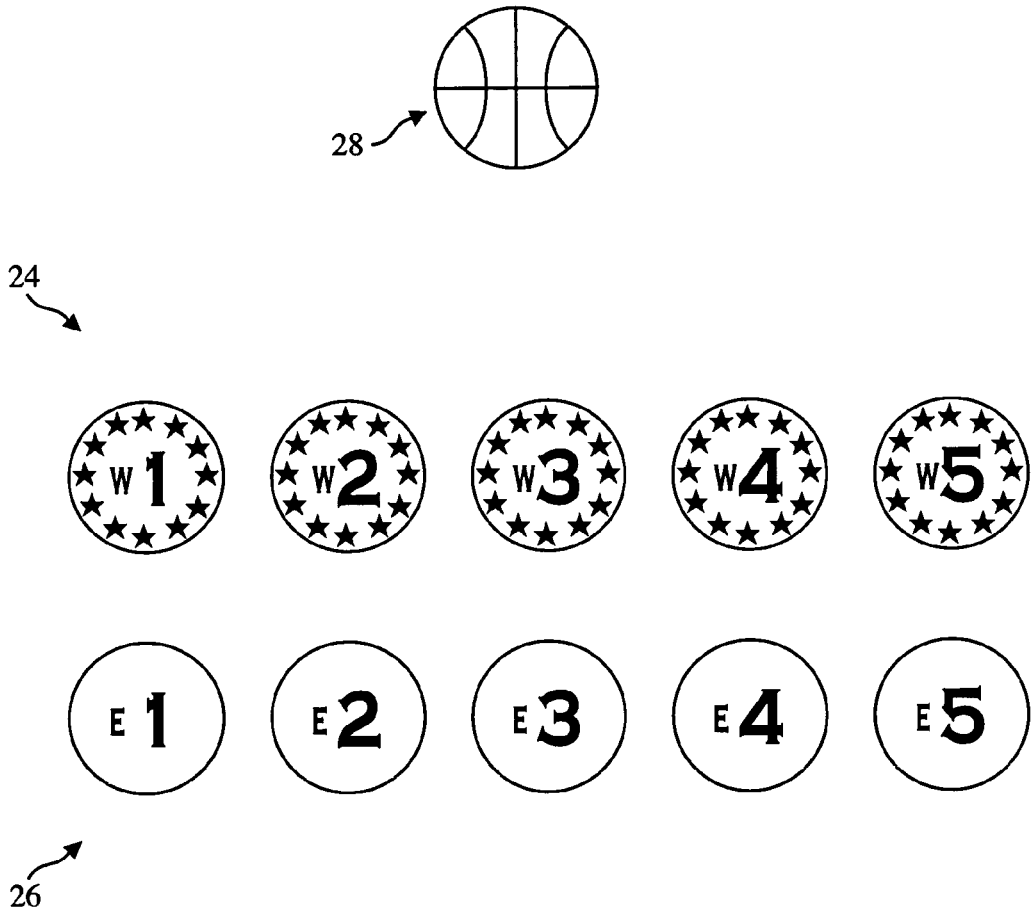
FIG. 2 is a top view of one embodiment of the player chips and the chip representing the basketball.

As shown in FIG. 2, the basketball board game includes ten Player Chips, five Western Conference chips 24 having a first color and five Eastern Conference Chips 26 having a second color, and one brown chip 28 representing the basketball. Both the five Western Conference Chips, and the five Eastern Conference Chips each may be sequentially marked with numerals 1 through 5 in order to represent each of the five basketball players on a team. Preferably, the chip marked with a 1 represents a point guard, the chip marked with a 2 represents the shooting guard, the chip marked with a 3 represents a small forward, the chip marked with a 4 represents a power forward and the chip marked with a 5 represents a center. However, an owner may choose to designate the player position for each chip in any arrangement. It is also understood that the present invention may include any other type of token to represent the players and ball. For example, basketball figurines may be used to represent each player and a substantially round piece may be used to represent the basketball.

Figure 6:
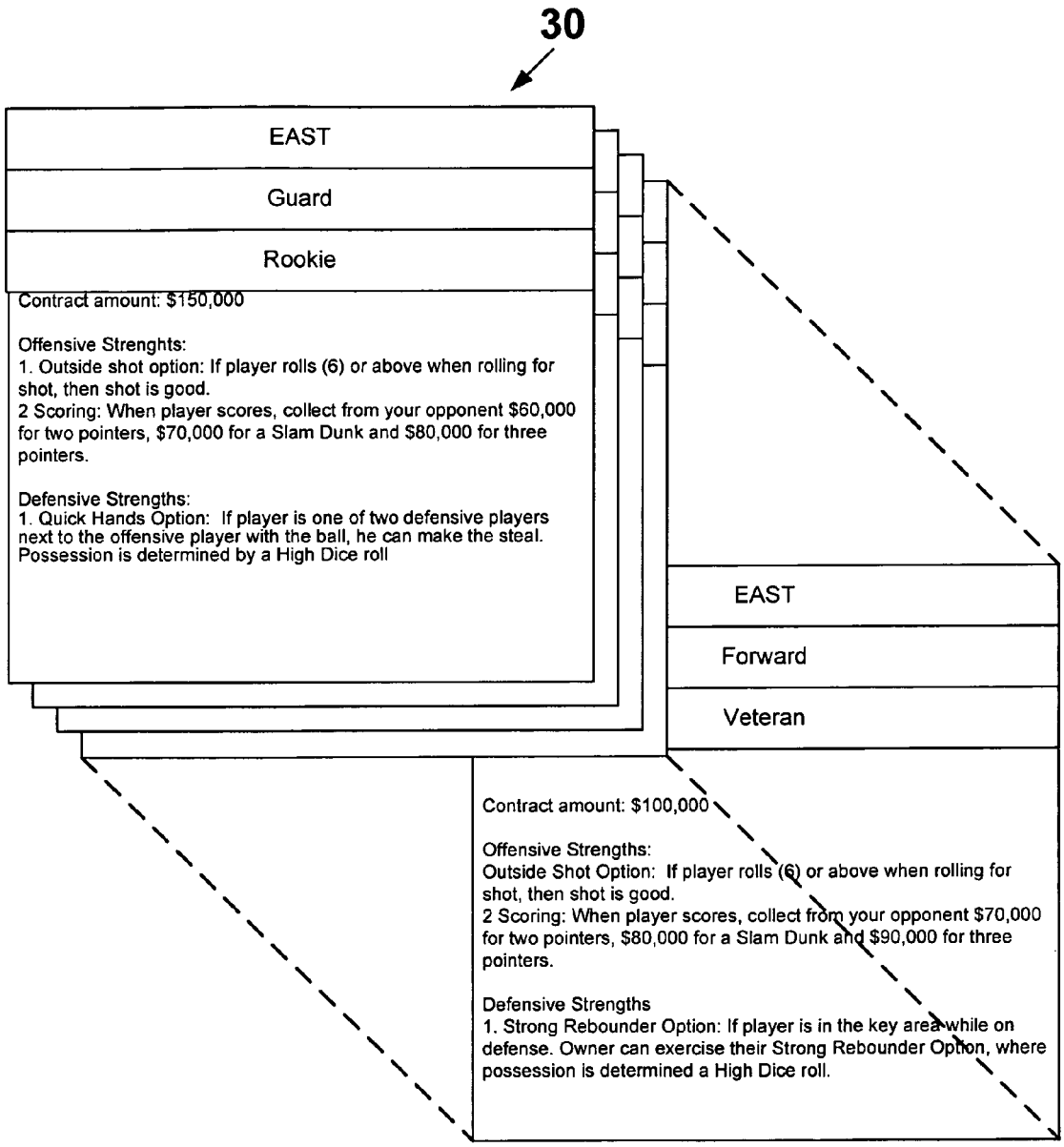
FIG. 6 is an illustration of one embodiment of a set of player cards for a first team.
Figure 7:
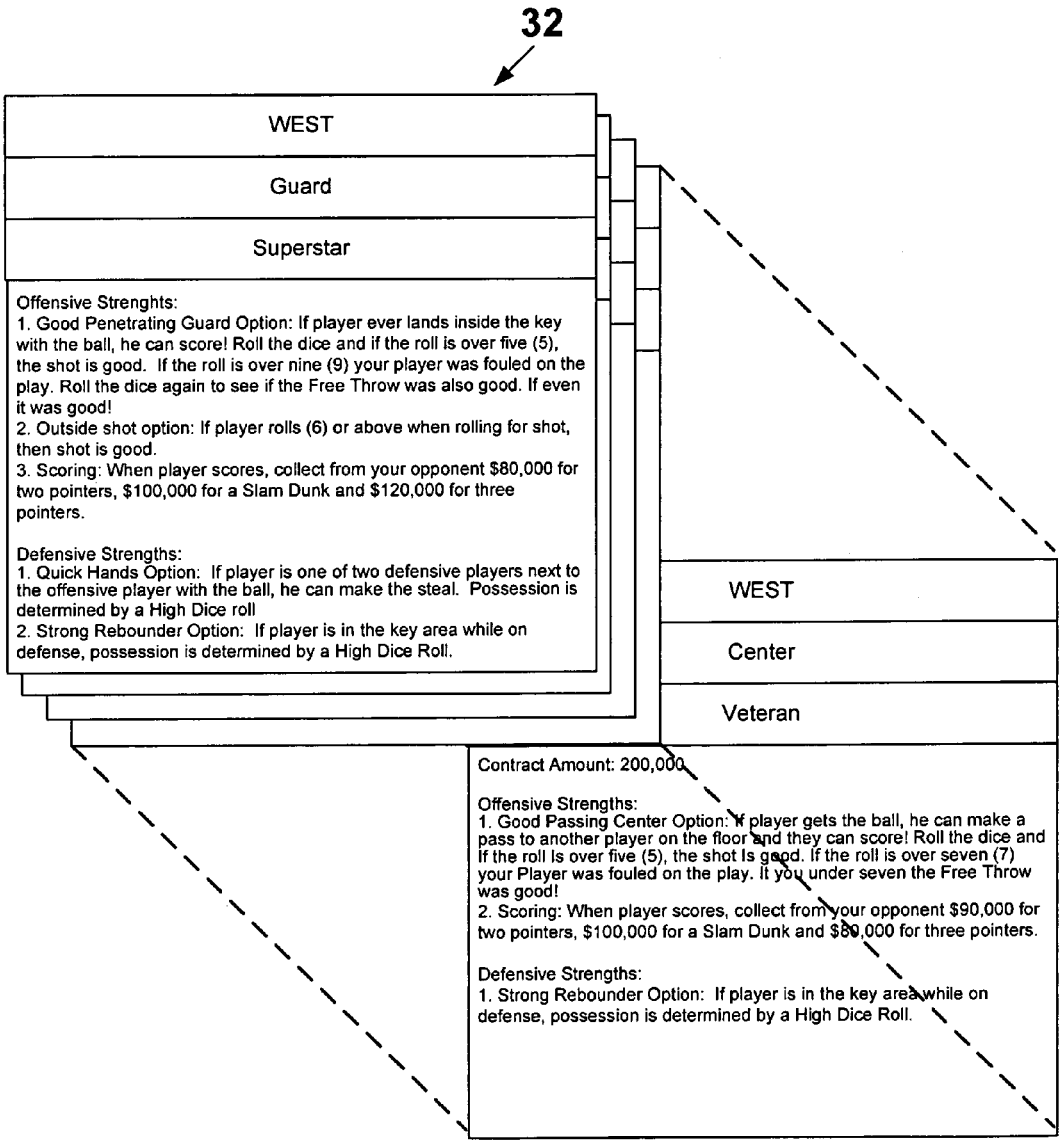
FIG. 7 is an illustration of one embodiment of a set of player cards for a second team.
Figure 8:
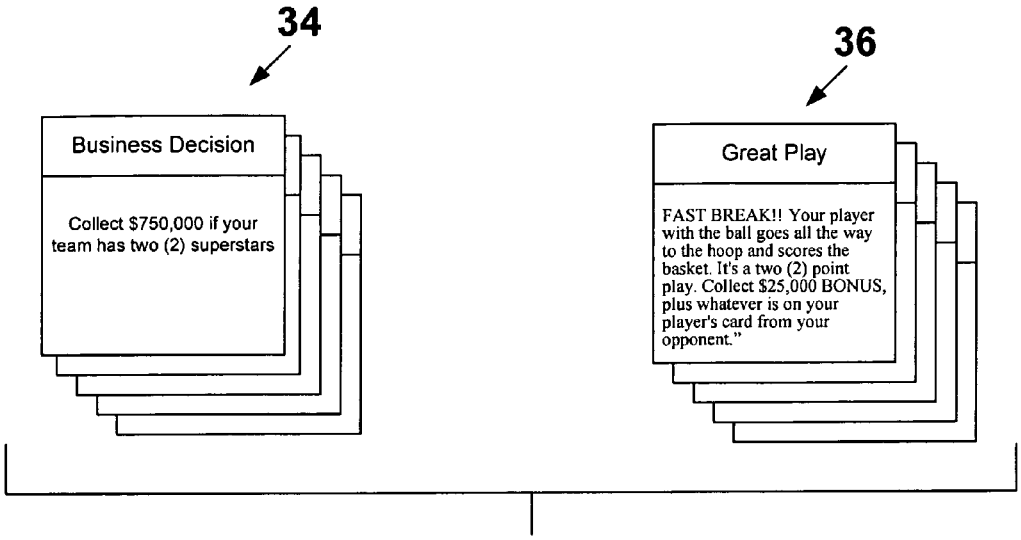
FIG. 8 is an illustration of one embodiment of a set of Business Decision cards and a set of Great Play cards.
Figure 9:
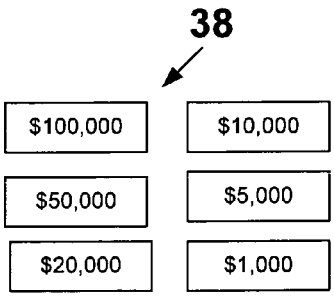
FIG. 9 is an illustration of various denominations of play currency.
Figure 10:
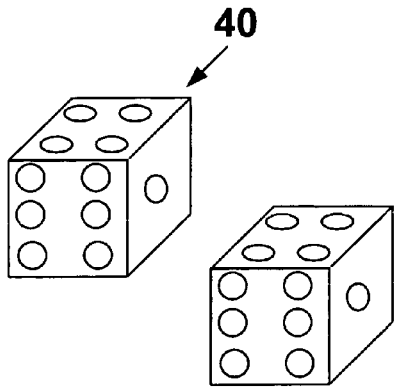
FIG. 10 is an illustration of a pair of dice.

As shown in FIGS. 6 and 7, the two sets of player contract cards 30 and 32 are also preferably divided into two conferences, East and West. Each set of player cards include cards representative of basketball players in different positions and with different skill levels such as Rookie Guards, Veteran Guards, Superstar Guards, Rookie Forwards, Veteran Forwards, Superstar Forwards, Rookie Centers, Veteran Centers, and Superstar Centers. Each player card may designate the characteristics of the basketball player. Each player card may also include a contract amount that is representative of the dollar value of the basketball player.

As examples, the following options, or any combination thereof, may be included on a Player Card:

"OUTSIDE SHOT OPTION: If player rolls six (6) or above when rolling for a shot, the shot is good!"

"GOOD PENETRATING GUARD OPTION: If player ever lands inside the key with the ball, he can score! Roll the dice and if the roll is over five (5), the shot is good. If the roll is over nine (9) your player was fouled on the play. Roll the dice again to see if the Free Throw was also good. If even it was good!"

"STRONG POST UP OPTION: If player ever lands inside the key with the ball, he can score! Roll the dice and if the roll is over six (6), the shot is good. If the roll is over eight (8) your Player was fouled on the play.

Roll the dice again to see if the Free Throw was also good. If Odd the Free Throw was also good!"

"GOOD PASSING CENTER OPTION: If player gets the ball, he can make a pass to another player on the floor and they can score! Roll the dice and If the roll Is over five (5), the shot Is good. If the roll is over seven (7) your Player was fouled on the play. It you under seven the Free Throw was good!"

"SIDE SHOT OPTION: If player rolls over six (6), when rolling for a shot, the shot is good! If even it was good!"

"SCORING: When player scores collect from your opponent, $60,000 for two (2) pointers, $70,000 for a Slam Dunk and $80,000 for three (3) pointers."

"THE QUICK HANDS OPTION: If player is one of two defensive players next to the offensive player with the ball, he can make the steal. Possession is determined by a High Dice roll."

"STRONG REBOUNDER OPTION: If player is in the key area while on defense. Owner can exercise their Strong Rebounder Option, where possession is determined a High Dice roll."

"GREAT SHOT BLOCKER: When opponents take a shot near this player he can Block The Shot. On the shouters dice roll if it is odd the shot was blocked. Possession is determined by a High Dice roll."

"THE FAST BREAK OPTION: If player is not in the key in a defensive rebound, then he can go coast to coast for the SLAM! If your Superstar Center get the rebound. If you have a Superstar Center, and he gets the rebound. The FAST BREAK Option comes into effect. Roll High Dice, if you win the roll, the pass was caught. Roll the dice to see how far he can advance. (5 times and this player becomes a Super Star) Roll High Dice. If you win the roll, the pass was caught. Roll the dice to see how far he can advance."

"BONUS RETURN FOR KEEPING CONTRACT $160, 000, $320,000 if Player becomes a Superstar!"

The basketball board game also preferably includes a bank having a predetermined amount of currency 38, slots for holding player contracts, and an Association Fund Section. To start the game, each owner receives a predetermined amount of currency from the bank. For example, each owner may receive one million dollars from the bank in the following currency: 5—$100,000, 5—$50,000, 7—$20,000, 5—$10,000, 4—$5,000, and 10—$1,000. Each owner then rolls one of the die to determine the Home Team or the Visiting Team. For instance, the owner that rolls the higher number may be the Home Team. The Home Team may then choose the conference (Eastern or Western) from which they will draft.

Each owner then buys their team using the play currency. The price that must be paid for each basketball player is the contract amount designated on each respective player card. The starting line-up consists of one center, two forwards, and two guards. At the beginning of the game, the owner may only purchase a maximum of two Superstar Players. Players not purchased will go into a Conference Box, where they may be purchased at a later time as discussed below. During the game, each team may carry a minimum of seven players and a maximum of twelve. If a team has less than, game play is stopped and the owner must purchase a player. If the team has more than, the owner must release as many players as it takes to get down to before play can resume. If an owner is caught with more or less than the minimum or maximum, the owner is fined $50,000 per player. All fines and fees assessed during the game will be paid to an Association Fund.

If at any point in the game, an owner has no money to continue to play, the owner may be required to make a loan from the Bank. All loans are made with a 10% interest rate agreement attached to them. All loans must be paid off before the end of the game.

If at any time during the game a player is injured, put on waivers, ejected, fouls out, or for any reason can not return to the game, their contact card must go into a Player on Waivers Box.

Example Play

Jump Ball

To begin the basketball game, each owner positions their player chips around the jump ball area with the Centers in the middle of the jump ball area 18 as shown in FIG. 2. The owners each roll a die and the high roll determines possession. Thus, the owner that rolls the higher number is on offense, and the owner that rolls the lower number is on defense. The owner on offense also gets control of the ball and the dice. If the owners roll the same number, the owners must roll again.

The number on the highest die during the jump ball also designates the offensive player that the ball is tipped to. For example, if a four is the high roll, the ball is tipped to the offensive player designated by the player chip marked with a "4". If the number six comes up on the dice, the owner may give the ball to any player.

The player having possession with the ball is indicated by placing the brown chip representing the basketball on top of that corresponding player. The board game may also include an additional token that the owner may place on top of the corresponding player card to indicate which player has possession of the ball.

After the ball goes to the designated player, the first move can go only backward or to the side. Thus, the offensive player that receives the tipped ball may not move towards the goal until the next roll of the dice.

Player Movement

Figure 3:
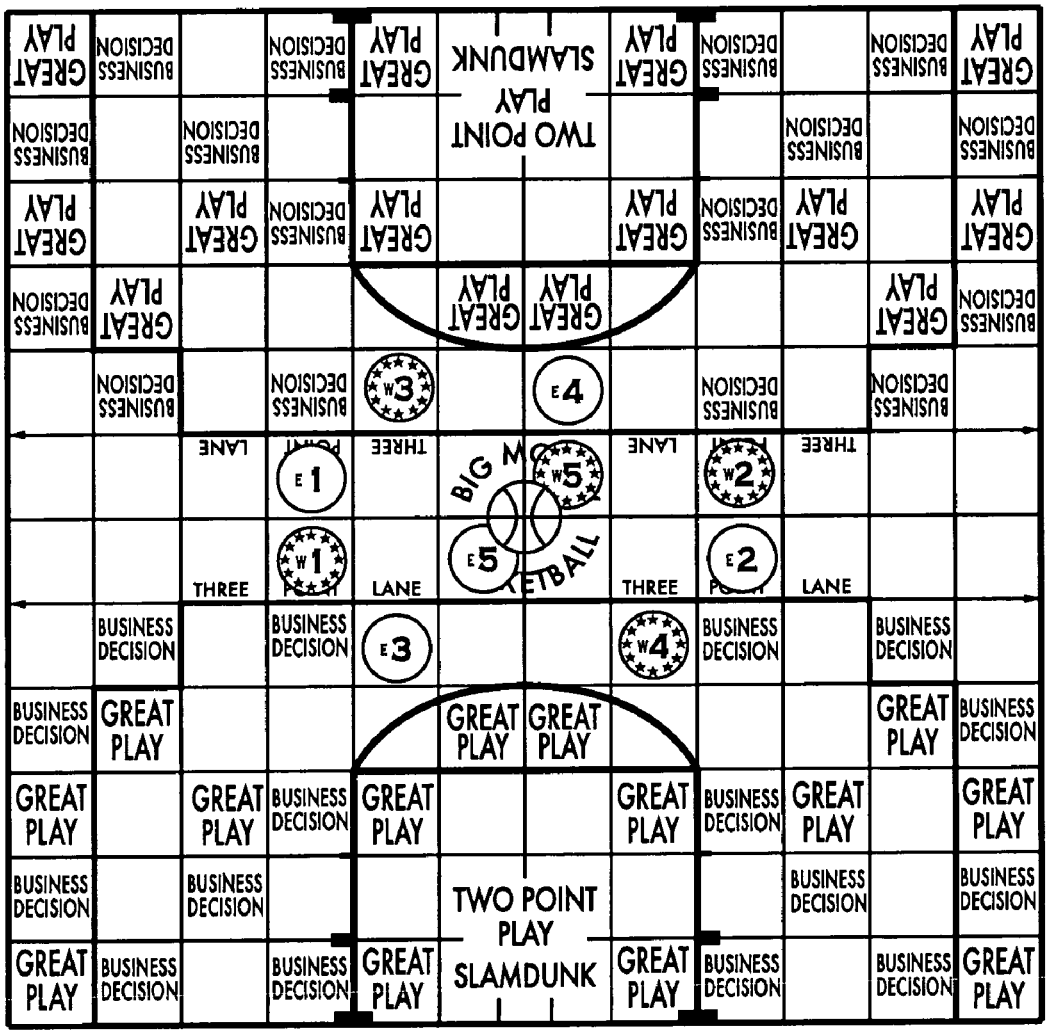
FIG. 3 is an illustration of a jump ball play.

Once an owner's player controls the ball, that owner is on offense and controls the dice. After the first move, each basketball player may move forward, backward, and to the side. Some Superstar Players, depending on their player cards, may also move on a diagonal, for one roll of the dice, during that possession. To begin a move, the offense rolls the dice and makes their move. The number rolled on each of the two die determines how many spaces a basketball player can move. For example, as shown in FIG. 3, if an owner roll five and a three, the owner has the option of moving one basketball player a total of eight spaces in one direction or five one way and three another way, or the owner may move two basketball players, one player five spaces and another three spaces. A player may not move off the game board. If the number shown on the dice is more than the available spaces on the game board, the owner must play another player or move in a different direction.

Whatever is rolled on the dice by the offensive team may also determine the defensive team movement. For example, if the offensive team rolls a five and a three, the defense moves its players as described for the offense above, however defensive players cannot move diagonally.

If a player lands on a space already occupied by an opposing team's player, then it is a foul. To determine if the foul is offensive or defensive, both owners roll the dice and the high roll wins. The winner of the roll gets the ball and control of the dice. The loser of this roll of high dice is called for the Player Control Foul.

If the offensive team roll doubles (both dice with the same number), this freezes the defense for that roll. If the offensive team rolls doubles a second time (two consecutive rolls), the player with the ball is called for traveling and must give up the basketball and the dice to the opposing team.

If during movement, any offensive player with possession of the ball lands on a Situation Spot ("Great Play" or "Business Decision") (see FIG. 1), the owner must take a card from the top of that deck. The owner then reads the card and carries out the action described in the card. Preferably, the "Business Decision" cards include instruction relating to the business aspects of owning of basketball team and the "Great Play" cards include instructions relating to basketball players and actual basketball plays. (Examples of "Business Decision" and "Great Play" cards are provided below.) If any offensive player lands on a space marked with a "$", the owner of the offensive player collects from the bank a dollar amount specified on the space.

If any offensive players are in the Key for more than three rolls of the dice, a three second violation is called and the offense must give up the ball. As a result the opposing owner receives the ball out of bounds at the endline and must inbound the ball (see inbound play described below).

Passing

To pass the ball, the offensive team owner must tell the opposing team owner that he or she is going to do so before rolling the die. If the basketball player with possession of the ball has any passing options, such as the Good Passing Option, on their player card, the rules for passing described on the Player Cards take effect. Otherwise, pass is done by rolling one die and that determines if the pass is good or bad. If the number five, four, three, two, or one comes up, the pass is good and the ball would be passed to the basketball player designated by the rolled number. Thus, if a five is rolled and one of players 1–4 has the ball, the player designated by the chip with a "5" gets the ball. However, if the number of the player who already has the ball comes up, then the pass was mishandled.

If the ball is mishandled (i.e. player 5 had the ball and 5 was rolled), both owners roll a die with the high roll determining possession. The number shown on the winning die designates the basketball player that receives possession of the ball. If the owner attempting a pass rolls a six, the defense gets a steal and possession goes to the defending basketball player closest to the ball.

Scoring

In order for a basketball player to shoot the ball, generally all basketball players on the offensive team must be across the half-court line. However, if the player contract card for the player with possession of the ball has the Fast Break Option, you do not need to have all of your basketball players across the Half-Court Line to shoot.

To shoot the ball, the offensive team owner must tell the opposing team owner he or she is going to do so before rolling the die. Whether the shot is a Slam-Dunk, a two pointer, or three pointer is determined by the space occupied by the shooting player on the game board. If the basketball player with the ball has any scoring option on his player card, the rules on the Player Card take effect. Otherwise, to determine if the shot is good, the owners each roll a die. If the offensive team rolls a higher number than the defensive team, the shot is good. If the offensive team rolls a lower number that the defensive team, the shot is missed.

If a basketball player scores, the owner of the basketball player that scores collects from the opposing owner an amount of money designated by the scoring player's contract card.

Rebounding

When a shot is missed no team has possession of the ball or dice. If any of the basketball players have rebounding options on their player contract cards, the rules on the player contract card take effect. Otherwise, possession is determined by winning a high dice roll. The owner that wins the high dice roll get the rebound. The rebound then goes to the basketball player on that owner's team closest to the basket, except if 6 is the winning number, the Center gets the rebound and makes an outlet pass to a player of your choice. (The Center can only get this rebound if he is inside of the three-point line.) If the player that receives the outlet pass from the Center has the FAST BREAK option, the defense must freeze for 2 rolls of the dice.

If the Center is not inside the three-point line, and the 6 is rolled, it is a Turnover and the opposing player closest to the basket gets the rebound. The opposing player can then immediately make an outlet pass also. In order to make the outlet pass, the owners roll High Dice to see if it is good, just like the rebound rule. If this player is near his own basket, the player may shoot the ball after getting the rebound.

Inbounding the Ball

Figure 4:
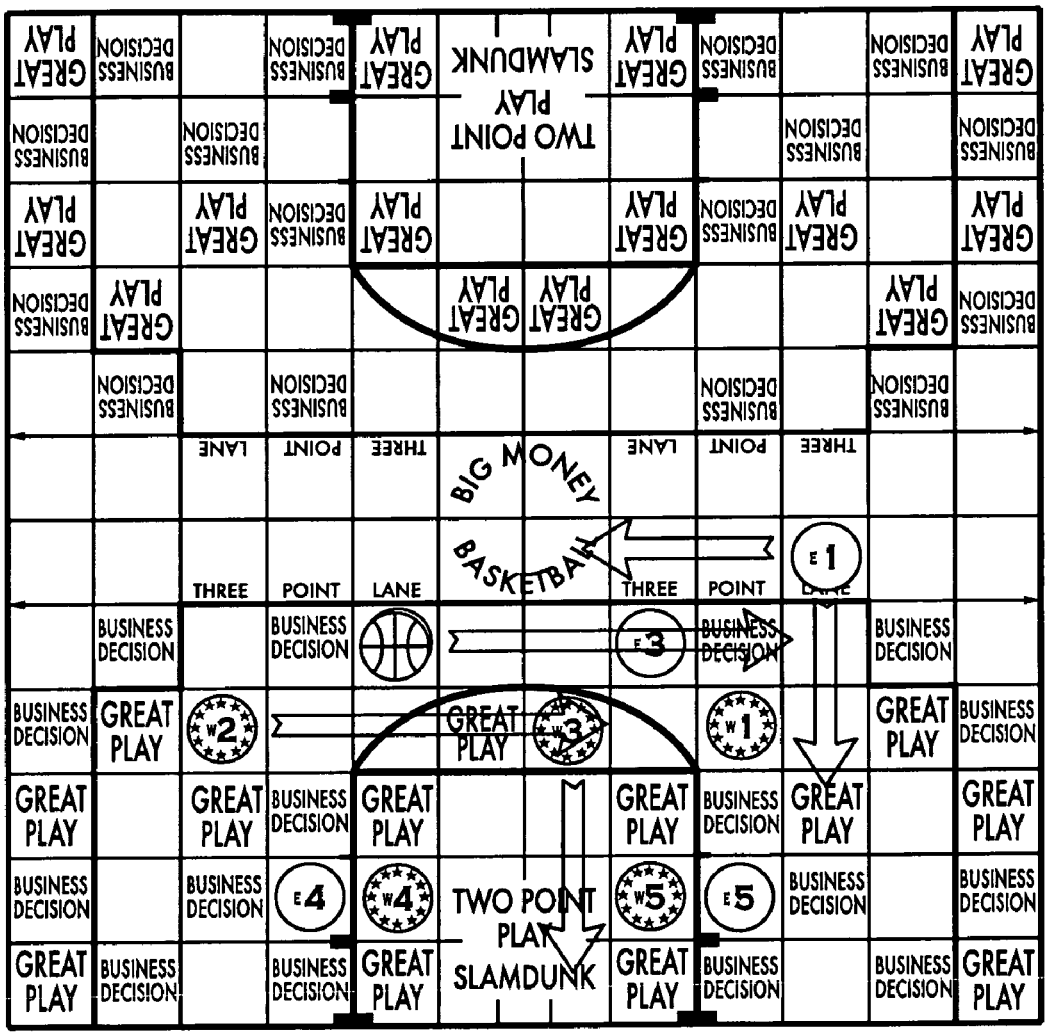
FIG. 4 is an illustration of the player movement on the game board.
Figure 5:
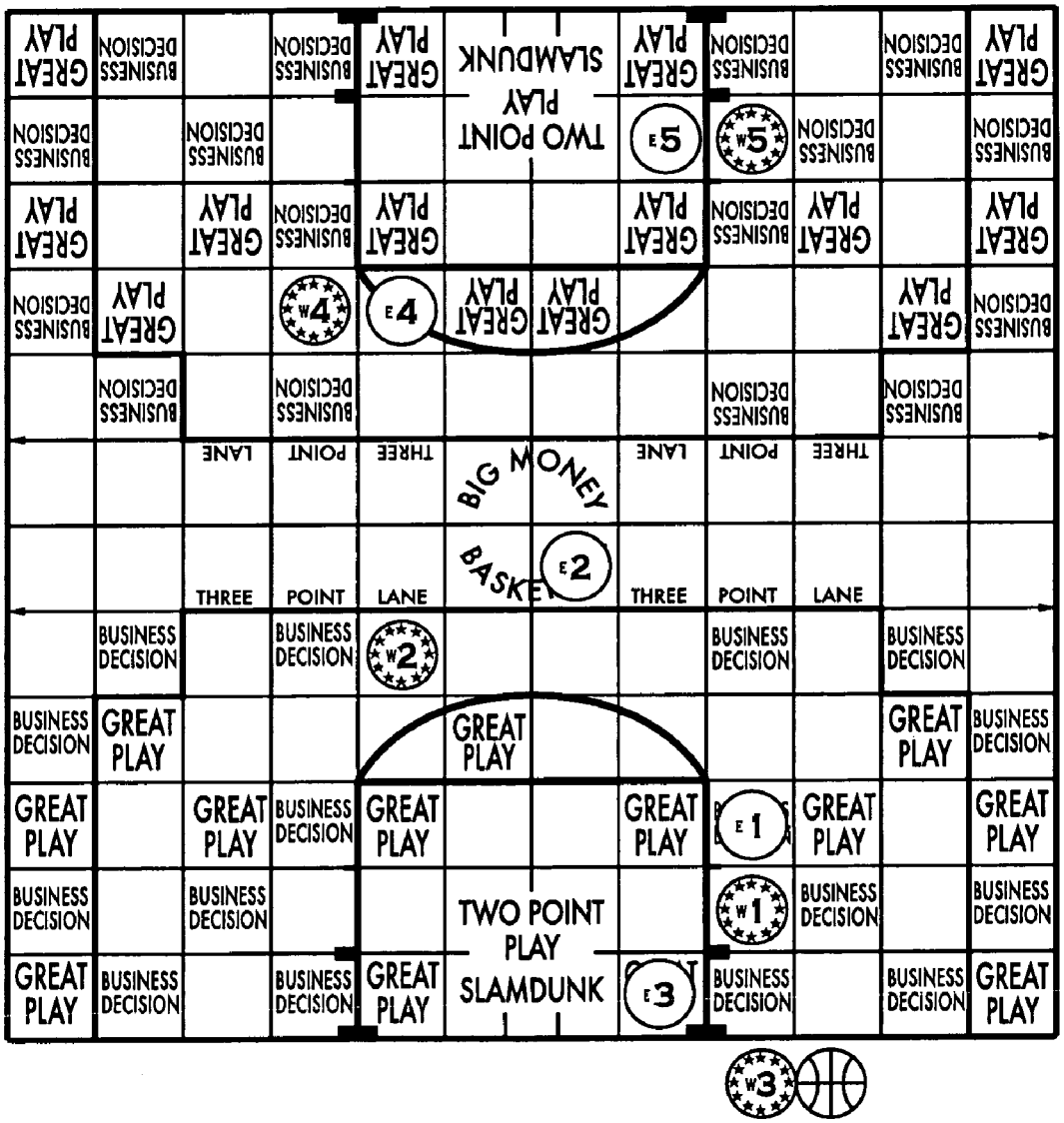
FIG. 5 is an illustration of an inbounds play.

On an inbounds play each owner may re-position their players anywhere they choose on the board. However, the player inbounding the ball must be positioned out of bounds near the sideline or inline as shown in FIG. 4. The owner on offense sets up his players first and then the defensive owner sets up his players. Only one player can possess a spot on the floor at one time. The offensive Team owner rolls a die, the number that appears on the die determines what player receives the ball. If 6 is rolled, it was a bad inbound pass, and the opposing team gets the ball at the same out of bounds spot. If the number on the die is that of the player out of bounds, the ball is considered deflected by the defense and the offense must redo the inbounds play again. If this occurs a second time, the defender has control and the defending owner gets to choose which player gets the steal.

After the ball is inbounded, the player who inbounded the ball must come back in on the floor in the lane next to where the ball was inbounded. This must happen on the next roll of the dice as a part of the offensive ball movement.

Stealing

If a defensive team player is in a space next to the player with the ball and his Contract Card shows the QUICK HANDS Option, he can steal the ball. In order to determine if the steal is successful, both owners roll a die. If the defensive owner has the highest roll, or (High Dice) for this roll, the steal is successful. If the defensive owner loses the high dice roll and the roll was 3 or less, the player trying to steal gets called for the Reach-In Foul.

Fouls

There are two types of fouls: personal and team foul. A personal foul may be called if two players land on the same space. A basketball player may also receive a foul in response to the instructions on a "Great Play" card. If a single player is charged with five personal fouls during a game, the player fouls out of the game and his player card is sent to the Conference Box.

Each foul received by any player on a team also constitutes a team foul. Each of the first 6 fouls received by a team, personal or technical, results in a turnover and possession goes to the opposing team. Team fouls 7 through 9 result in the opposing team going to the bonus. Once a team is in the bonus, the player that was fouled is awarded a "one-on-one" free throw. Thus, the player receives a first Free Throw. If the player makes the first free throw, he is awarded a second free throw. If the player misses the first free throw, then the players must roll to determine who gets the rebound, as described below. After the tenth Team Foul, the team is in the Double Bonus. In the Double Bonus, any player that was fouled receives two Free Throws.

Free Throws

Free throw Shots are taken at the Free Throw Foul Shot Line. Before shooting the free throw, both offensive and defensive players line up around the Key area. Just as in any basketball game, there are free throws of 2 shots for shooting fouls within the three point line, or 3 shots for shooting fouls from the 3-point area, and when there are more than 7 fouls in a quarter, free throws are in the bonus of one and one, as discussed above.

To determine if the free throw is good, each owner rolls a die. If the owner of the player shooting the free throw rolls the higher number, the free throw is good. If the opposing owner rolls the higher number, the free throw is missed.

For each free throw made, the owner of the player that made the free throw collects from the opposing owner an amount of money designated on the player card for the player that made the free throw. If the player card only designates a dollar value for made two point shots, the owner collects half of this value for each free throw.

Time Outs

Each owner preferably receives 3 timeouts per quarter. The owner who controls the ball may call timeout at any time. During a timeout, the owner may substitute any of the players on his team. After the timeout, the offensive team inbounds the ball.

If an owner calls for a timeout after the 3 allotted timeouts have already been used, a technical foul is assessed. As a result, the owner called for the technical foul loses possession of the ball and is fined $50,000 which is paid directly to the opposing player.

Gate Receipts

In one embodiment, once a team scores twenty points (and for every twenty points scored thereafter), the owner of that team rolls both dice to determine Fan Attendance Net Profit. For example, the net profit on the Gate Receipts may be determined as shown in the Table below:

| Roll | Fans | Net Gate Profit | Home Team | Visitors |
|---|---|---|---|---|
| 2 | 2,000 | $20,000 | $12,000 | $8,000 |
| 3 | 3,000 | 30,000 | 18,000 | 12,000 |
| 4 | 4,000 | 40,000 | 25,000 | 15,000 |
| 5 | 5,000 | 50,000 | 30,000 | 20,000 |
| 6 | 6,000 | 60,000 | 36,000 | 24,000 |
| 7 | 7,000 | 70,000 | 40,000 | 30,000 |
| 8 | 8,000 | 80,000 | 46,000 | 34,000 |
| 9 | 9,000 | 90,000 | 56,000 | 36,000 |
| 10 | 10,000 | 100,000 | 60,000 | 40,000 |
| 11 | 11,000 | 110,000 | 65,000 | 45,000 |
| 12 | 12,000 | 120,000 | 70,000 | 50,000 |

Thus, if an owner rolls a total of 6, the home team receives $36,000 and the visiting team receives $24,000 from the bank.

Game Duration

Preferably, the basketball game is divided into four quarters. The length of each quarter, and the length of the entire basketball game may be determined by a predetermined number of points or a time limit. For example, each quarter may end after 25 points are scored, or each quarter may end after 20 minutes. Alternatively, the game may also be played in two halves, or as one period. If the game is divided into quarters or halves, each quarter or half begins with a jump ball.

At the end of each basketball game, each owner receives a Bonus Each owner rolls both dice to determine the amount of their Bonus. The following chart shows what the roll of the dice is worth. If a single team has multiple owners, each owner may roll to determine a bonus.

| Roll | Total | Winner | Loser |
|---|---|---|---|
| 2 | $200,000 | $120,000 | $80,000 |
| 3 | 300,000 | 180,000 | 120,000 |
| 4 | 400,000 | 250,000 | 150,000 |
| 5 | 500,000 | 300,000 | 200,000 |
| 6 | 600,000 | 360,000 | 240,000 |
| 7 | 700,000 | 400,000 | 300,000 |
| 8 | 800,000 | 460,000 | 340,000 |
| 9 | 900,000 | 560,000 | 360,000 |
| 10 | 1,000,000 | 600,000 | 400,000 |
| 11 | 1,100,000 | 650,000 | 450,000 |
| 12 | 1,200,000 | 700,000 | 500,000 |

At the end of the game, each owner looks at the Player Contract Cards to determine the Redemption Value of all players that are still owned. If a player has increased his ability, that player may also have an increased dollar amount on his redemption value.

At the end of the game, the winner is not determined by the most points scored, but by the mount of profit made. Thus, each team adds up their money (including currency and player Redemption Value) and the owner with the greatest amount of money is declared the winner.

Finally, as described above, when a player with possession of the basketball lands on a space marked "Business Decision" or "Great Play" during the game play, the owner must draw a card from the respective set of cards, read the card aloud, and follow the instruction on the drawn card. As examples, the "Business Decision" cards 34 may include one or more cards each with the following types of instructions:

"Collect $550,000, if your team's Veteran player excepted any type of salary reduction."

"It is a time to pay for all salary re-negotiations. All player contracts have increased by $50,000, all money from shots made increased by $10,000, from the Big Money Basket Association Fund. Also if your team is in the lead collect an additional $250,000."

"You must pay the Big Money Basketball Association Fund $150,000, for stadium maintenance."

"Your Team gets a TAX REFUND! Roll the dice to see what the refund is. (2)—$200,000; (3)—$300,000; (4)—$400,000; (5)—$500,000; (6)—$600,000; (7)—$700,000; (8)—$800,000; (9)—$900,000; (10)—$1,000,000; (11)—$1,100,000; (12)—$1,200,000."

"Collect $250,000 for Gate receipts, from the Big Money Basketball Association Fund."

"The Commissioner of Basketball disapproves of the last deal you completed for your last Superstar Player you purchased. He does not feel that it is enough compensation to the team you purchased this player from. Nor does he feel it is in the best interest of basketball. To keep this player you must pay the Big Money Basketball Association Fund an additional $75,000, plus give up one of your players on the bench."

"Collect $750,000, if your team has two (2) Superstars."

"You must pay the Big Money Basketball Association Fund $100,000, for travel expenses for your last road trip."

"Player Strike!!! To settle dispute other owners must pay a 60–40% split on the settlement. Who ever picked this card must pay the 60% of the settlement. Roll the dice to see what the amount will be for the settlement total:
2—$200,000; 3—$300,000;
4—$400,000; 5—$500,000;
6—$600,000; 7—$700,000;
8—$800,000; 9—$900,000;
10—$1,000,000; 11—$1,100,000;
12—$1,200,000;

paid to the Big Money Basketball Association Fund."

"PLAYER ARBITRATION!!! To settle this dispute roll the red die, to see how much more you will have to increase his contract. 1—$100,000; 2—$200,000; 3—$300,000; 4—$400,000; 5—$500,000; 6—$00,000. To keep this player, pay the Big Money Basketball Association Fund, another $125,000 or he becomes a Free Agent."

"Collect $350,000 for the Snack Bar Profit, from the Big Money Basketball Association Fund."

"Collect $230,000 for the Snack Bar Profit, from the Big Money Basketball Association Fund."

"Stadium Taxes are due! Roll the dice to see what you have to pay the Big Money Basketball Association Fund for your taxes. Each number on the dice is equal to $20,000."

"Stadium Taxes are due! Roll the dice to see what you have to pay the Big Money Basketball Association Fund for your taxes. Each number on the dice is equal to $10,000."

"To be used when needed, once to get out of a jam. If you the owner are required to pay a fine this card will allow the Fees to be waved."

"Your Superstar Guard that had injured his hand, but his injury are really minor. He will be able to return to the game. Roll one die to see how many moves it will take for him to reenter the game."

"Your Superstar Forward has just injured his knee, but the injury is really minor. He will be able to return to the game. Roll one die to see how many moves it will take for him to reenter the game."

"Collect $250,000 from the Big Money Basketball Association Fund, for the tax refund for your donation to the Community Center."

"All your Concession Stands must be restocked. Pay the Big Money Basketball Association Fund, $65,000."

"After the next two (2) points are made, your Superstar Center, can become a FREE AGENT. To keep him, you must renew his contract. Pay the Big Money Basketball Association Fund $250,000."

"Before the next roll, your rookie player is at the end of his contract and if he has scored it any time during the game, he is now a superstar. To keep him pay $150,000, to The Big Money Basketball Association Fund. His contract is know worth $300,000 and add $50,000 as a pay out for any point he makes during the rest of the game."

"Collect $150,000 from the Big Money Basketball Association Fund, if your team is in the lead at this time in the game. It's Fan Appreciation night!"

"Collect $450,000 from the Big Money Basketball Association Fund, if your team is in the lead at this time in the game. It's Fan Appreciation night!"

"Collect $250,000 from the Big Money Basketball Association Fund, if you have purchased a player that is on your roster with a contract of $200,000 or above."

"One of your sponsors wants to show some advertising in your Stadium. Roll the dice to see what you will charge? 2—$200,000; 3—$300,000; 4—$400,000; 5—$500,000; 6—$600,000; 7—$700,000; 8—$800,000; 9—$900,000; 10—$1,000,000; 11—$1,100,000; 12—$1,200,000."

"Stadium Remodeling Taxes are due! Roll the dice to see what you have to pay the Big Money Basketball Association Fund for your taxes. Each number on the dice is equal to $20,000."

"Your Veteran Forward has just retired. If you are the Home Team, pay $150,000 and he must be replaced before you can move. If you are the Visiting Team, pay $100,000 and he must be replaced before you can move. All fees shall go to the Big Money Basketball Association Fund."

"Collect $250,000 from the Big Money Basketball Association Fund, from vendors doing business in your stadium."

"Your Veteran Player will except his contract re-negotiation to reduce his asking price, so team will be under the salary cap! When player scores from this point forward collect and additional amount of $25,000."

"Your Superstar Player has just become a FREE AGENT! Roll the dice to see how much he's asking! (2)—$200,000; (3)—$300,000; (4)—$400,000; (5)—$500,000; (6)—$600,000; (7)—$700,000; (8)—$800,000; (9)—$900,000; (10)—$1,000,000; (11)—$1,100,000; (12)—$1,200,000. If you decide to keep this player, each time he scores a two pointer you can collect another $50,000, for Slam Dunks a additional $75,000 and for three pointers an additional $100,000, from the Big Money Basketball Association Fund. If you do not buy his contract, you lose him to the open market, where all new options apply."

"Your Superstar Player has just become a FREE AGENT! Roll the dice to see how much he's asking! (2)—$200,000; (3)—$300,000; (4)—$400,000; (5)$500,000;

(6)—$600,000; (7)—$700,000; (8)—$800,000; (9)—$900,000; (10) $1,000,000; (11)—$1,100,000; (12)$1,200,000. If you decide to keep him, each time he scores a two pointer you can collect another $ 100,000, and for three pointers and SLAM DUNKS, an additional $200,000, from the Big Money Basketball Association Fund. If you do not buy his contract, you lose him to the open market, where all new options apply. If your opponent wants to buy out this player's contract it cost him only half this player's contract amount."

"Tax Refund collect $350,000 from the Big Money Basketball Association Fund, for your donation to The Local Children Center."

"The Commissioner of Basketball disapproves of the last deal you completed for the last Superstar Player you purchased. You have just went over the salary cap. To keep this player, pay the Big Money Basketball Association Fund, $125,000."

"Collect $500,000 for Gate receipts, from the Big Money Basketball Association Fund."

"Your Guard has just been injured by an object that was thrown out of the stands. He must be taken to the hospital. If you are the Home Team, pay $30,000 for injuries and if you are the Visiting Team, $15,000. All fees shall go to the Big Money Basketball Association Fund."

"Collect $250,000 for the Snack Bar Profit, from the Big Money Basketball Association Fund."

"Tonight is T -Shirt Night. Pay $75,000 the Big Money Basketball Association Fund for the t-shirts. Now roll the red die to see how much extra profit you made 1—$100,000; 2—$200,000; 3—$300,000; 4—$400,000; 5—$500,000; 6—$600,000. Collect the proceeds from the Big Money Basketball Association Fund."

Similarly, the "Great Play" cards 36 may include one or more cards each with the following types of instructions:

"GREAT PLAY: It's a High Lob to your Forward. You must roll high dice to see if the dunk is good. Roll over five (5) on the dice and the SLAMDUNK is GOOD! Collect $100,000 from your opponent on the play as well as what's on the players contract card for a Slam Dunk."

"WHAT A STEAL!! Your opponent's player closest to the ball make a great steal. Roll the dice to see how many spaces that this player can move towards his own goal. An (even) roll means the new defender can not move with this roll of the dice, he is frozen in his tracks; an (odd) roll means that the new defender can only move based on one of the numbers on the dice. The new defenders cannot move on the number shown on the dice. This team must wait until the next roll."

"PENALTY: Technical Foul called on your Rookie for verbal exchange with the referee. This penalty will cost you $50,000, the ball and a free throw shot for your opponent. Roll high dice to see if the free throw was good. Pay $20,000 to The Big Money Basketball Association Fund for the fine."

"THREE (3) POINT PLAY, this card will give your Shooting Guard an automatic Three Pointer next time he is in the three point area. Collect $50,000 from your opponent for three (3) pointer. Plus also whatever appears his player contract."

"Your Rookie Guard has just become a THE PREMIERE GUARD of the league! Your opponent must pay you an additional amount for each time this player scores. $100,000 for each Dunk, $80,000 for each three (3) pointer and $50,000 for two (2) pointers. If you do not have a Rookie Guard in the game or on the bench, this GREAT PLAY card does not apply. If you do, collect $50,000 from the Big Money Basketball Association Fund as well."

"What a play! Go directly to the closest SLAM DUNK spot. Your player with the ball makes a great play. But he is hanging on rim and breaks the glass. It's going to cost you, pay the Big Money Basketball Association Bank $50,000 to replace backboard and rim. However you can still collect from your opponent whatever this player's contract card says for Slam Dunking the ball and putting two points on the score board."

"The ball is tied up by two players and the referee calls for a jump ball. Player must go directly to the jump ball spot at center court. You must roll high dice to see who gets the ball and the dice. The team that gets the ball also collects $100,000 from their opponent."

"The "Backdoor Play" works to perfection. Score two (2) points, plus roll the dice to see if there was a foul call on the play. If the roll is even your player was fouled on the play. Roll high dice to see if the Free Throw was good. Collect $50,000 from your opponent for two (2) pointer and $20,000 for the Free Throw, in addition to whatever is on the player's Player Contract Card."

"Your Rookie Player has just become a Superstar. Your opponent must pay you an additional amount for each time this player scores, $80,000 for each Dunk, $50,000 for each three pointer and $30,000 for each two (2) pointer. If you do not have a Rookie in the game or on the bench, this GREAT PLAY card does not apply. If you do collect $50,000 from the Big Money Basketball Association Fund."

"Your player with the ball fakes left and dribbles right and gets by his man. Roll the dice to see if his shot is good. An even roll means the shot is good; and an odd roll means it was not."

"Dazzling Play, but your Power Forward or (Superstar) is called for a foul. You must pay your opponent $50,000 and give you position of the ball and the dice."

"It's a High Lob to a Superstar of your choice. You must roll high dice to see if the dunk was made. Roll over five (5) on the dice and the SLAM DUNK is GOOD. Collect $100,000 from their opponent on the play as well as what's on the players contract card for a SLAM DUNK!!"

"Your Veteran Player has just become a Superstar after a long career. Your opponent must pay you an additional amount for each time this player scores. $80,000 for each Dunk, $50,000 for each three pointer and $30,000 for each two (2) pointer. If you do not have a Rookie in the game or on the bench, this GREAT PLAY card does not apply. If you do collect $50,000 from the Big Money Basketball Association Fund."

"PENALTY: Great Play, but Strong Side Forward (Superstar Forward) was called for holding. You must pay your opponent $70,000 and give up position of the ball."

"GREAT PLAY: Your Weak Side Forward or (Superstar Forward) and your Point Guard just ran a great give and go play and your Guard lays it in for the two (2) point score. In addition to the amount shown on the Guard's contract card add another $50,000 from your opponent."

"Your Power Forward or Superstar tries to do a crossover dribble and tries to drive to the hoop but gets the ball stolen. What a steal by your opponents Point Guard or Superstar Guard. This is what we call getting ripped and, it's going to cost you. Pay your opponent $50,000 and The Big Money Basketball Association Fund $50,000 and also and give up the ball and the dice."

"What a great pass to a Superstar or a player of your choice. You must roll high dice to see if the dunk is good. Roll five (5) or over on the dice and the SLAM DUNK is GOOD. If you win the high dice roll collect $100,000 from your opponent on the play as well as what's on the players contract card for a SLAM DUNK."

"It's a "Pick and Roll Play" that works to perfection between two (2) players that you select. Score two (2) points, plus roll the dice (even), and your player was fouled on the play. Roll high dice to see if the Free Throw was good. Collect $50,000 from your opponent for two (2) pointer and $20,000 in addition for the Free Throw."

"Your Superstar Player has just retired, after a long career. You must now replace him with a new player. If you do not have a Superstar Player on the court at this time, pay $100,000 to The Big Money Basketball Association Fund. Once you have paid this debt your new player become a Superstar, and takes over the entire contract value of the retired Superstar's values."

"BONUS: You may now collect $500,000 of The Money Basketball Association Fund."

"PENALTY: Great Play, but Point Guard or (Superstar Guard) was called for holding. You must pay your opponent $50,000 and give up position of the ball."

"Technical Foul called on one of your players on the floor for verbal exchange with the referee. Roll one die to see which player it is, 1—Point Guard; 2—Shouting Guard; 3—Weak Side Forward; 4—Strong Side Forward; 5—Center; 6—FREE PASS. This penalty will cost you $50,000, the ball and a free throw shot for your opponent. Roll high dice to see if the free throw is good. Pay $50,000 to The Big Money Basketball Association Fund for the fine."

"GREAT PLAY: The ball was just passed to your Point Guard, roll the dice to see if he can snake though the defense and score in continuation? An (even) roll means he laid in a lay up off the glass, and an odd roll means that the shot was blocked. Roll high dice to determine if a foul was called on the defense during the blocked the shot. If the foul was called role high dice again to see if the free throw is good."

"Your Superstar Forward has just injured his knee. He will be out for the remainder of the game. The hospital bill and rehabilitation will cost you $100,000."

"Your player with the ball fake right and dribbles left, can he go all the way to the HOOP? You get one free roll of the dice, without the defense moving."

"The Player's Union calls for a strike! Roll the dice to see how much money it is going to cost you to settle this potential strike. 2—NO STRIKE; 3—NO STRIKE; 4—NO STRIKE; 5—NO STRIKE; 6—NO STRIKE; 7—NO STRIKE; 8—$280,000; 9—$290,000; 10—$300,000; 11—$310,000; 12—$320,000."

"GREAT PLAY: The Player's Union call for a strike! Roll one die to see how much it will cost you to settle.
1—$100,000; 2—$200,000;
3—$300,000; 4—$400,000;
5—$500,000; and 6—A FREE PASS (NO STRIKE)
Pay the money to the Big Money Basketball Association Fund, 5% will be paid by your opponent."

"JUMP SHOT!! Your player with the ball takes the shot. Roll the dice to see if the shot was good. An even roll of the dice means the shot is good; an odd roll means that it is not. However if the player with the ball is a Superstar, the shot is good and you need not roll the dice."

"Your Weak Side Forward or (Superstar Forward) and your Center just ran a great "Give and Go Play" and your Forward SLAM DUNKS it home for the two (2) point play. In addition to the amount shown on your forward's contract card add another $50,000 that your opponent must pay you. If your Center does not have the ball or is out of position, to make the play you now are getting a free roll of the dice to move this player and complete this play."

"Collect from The Big Money Basketball Association Fund, $100,000 if one of your players the most rebounds in the game."

"Gate Profit Time!! To find out how much profit you shall collect from the gate receipts. Roll the dice to see how much The Big Money Basketball Association Fund owes you? Roll 2—$200,000; 3—$300,000; 4—$400,000; etc . . . "

"Your player has just been ejected from the game for throwing a punch at another player. Roll the dice to see which player has been kicked out of the game. If you have a FREE PASS and you want to keep this player in the game it would be a good time to use it."

"Parking Lot Profit Time!! To find out how much profit you shall collect from The Big Money Basketball Association Fund. Roll the dice and collect $25,000 for each spot on the dice."

"Your Superstar Player has just become a THE PREMIERE PLAYER of the league! Your opponent must pay you an additional amount for each time this player scores. $100,000 for each Dunk, $80,000 for each three (3) pointer and $50,000 for two (2) pointers. If you do not have a Superstar on your team, roll one die to see which player becomes a Superstar. (The number the one die corresponds to the number on each player chip.) If you do have a Superstar collect $500,000 from the Big Money Basketball Association Fund and an additional $150,000 each time this player scores, a (2) two pointer, (3) three pointer or SLAM DUNK. This will be in effect for the remainder of the game. If a six is rolled, you have a Free Pass to select any player of your choice."

"WHAT A REBOUND!! This card can be used to get a rebound over all others. Roll one die to see if your player that got the rebound and was able to put the ball back in the hoop. An (even) roll means that the shot is good. An (odd) roll means that the shot is no good. If the six (6), is rolled it's a SLAM DUNK."

"Great Play by the Defense! The Defensive Team's Power Forward, just blocked and stopped your next play. You must pay your opponent $50,000 and give up possession of the ball."

"It's a High Lob to your Center. You must roll high dice to see if the dunk is good. Roll over five (5) on the high dice roll and win the roll, the SLAMDUNK is GOOD. Collect $100,000 from their opponent on the play as well as what's on the players contract card for a SLAM DUNK."

"Great Play by the Defense! Your opponent's (Rookie Guard), just cut your FAST BREAK off. Roll the dice to see if there is a call by the referee on the contact. If the roll is (even) it's a CHARGING FOUL on your player with the ball. If the roll is (odd) it's a BLOCK- ING FOUL on the dense. Who ever loses the roll they must give up the ball and the dice and must pay their opponent $50,000."

"Your player with the ball fake left and dribbles right, can he go all the way to the HOOP? You get one free roll of the dice, without the defense moving."

"GREAT DEFENSE: Great Play by the Defense! Their (Weak Side Forward), just blocked and stopped your next play. You must pay your opponent $50,000 and give up position of the ball. Your opponent can only used this card if you're not playing a Great Play card yourself on this possession of the ball."

"GREAT PLAY: Your Shooting Guard or (Superstar Guard), in your next possession shoot a three (3) pointer. Roll the dice (even) the shot is good; (odd) the shot is not. In addition to the amount shown on the Guard's contract card add another $50,000 from to be paid by your opponent."

"PENALTY: CHARGING OR BLOCK, was called by the referee, roll High Dice to see who the foul was called on? You must give up the ball and the dice; and pay your opponent $60,000, if you have the ball. If you are on defense it will cost you $75,000."

"GREAT PLAY: The ball was just passed to your Center, roll the dice to see if he can back the defense down (closer to the basket) and score? An (even) roll means he banked in a shot, off the glass, and an odd roll means that the shot was blocked by the defense. If the shot was blocked, roll high dice for control of the rebound? If the defensive player's number comes up on the highest die the defender made contact with the player shooting and was called for the foul out of bounds play comes into effect."

"Collect from The Big Money Basketball Association Fund, $100,000 if one of your players gets the next steal in the game."

"Your Rookie Guard has just injured his ankle. He will be out for the remainder of the game. The hospital bill and rehabilitation will cost you $100,000."

"PENALTY: Player that has the ball, was called for a Player Control Foul or Charging while he is driving to the basket. This is an Offensive Foul, you must give up the ball and the dice."

"This Card allows your Center freely move into the post position for the next play. The ball can now be passed to your Center as he rolls towards the hoop and throws up a hook shot. Roll the dice to see if the shot was good. An even roll means the shot was good, and an odd roll means it was not. If shot was not good, roll high dice for control of the rebound."

"Collect from the Big Money Basketball Association Fund, $100,000 if one of your players has the highest point total in the game."

"Your Superstar Guard has just injured his hand. He will be out for five rolls of the dice. The rehabilitation will cost you $60,000."

"Your Superstar Forward has just injured his hand. He will be out for the remainder of the game. The hospital bill and rehabilitation will cost you $100,000."

"PENALTY: Your player with the ball fakes left and dribbles right and gets his arm out toward the defender. The offensive foul of"Charging" is called on your player."

"FREE PASS: To be use when needed once, to get out of a jam. This card will help you over ride any Great Play you want, use it wisely."

"PENALTY: Technical Foul called on your Rookie Center for verbal exchange with the referee. This penalty will cost you $50,000, the ball and a free throw shot for your opponent. Roll high dice to see if the free throw is good. Pay an additional $50,000 to The Big Money Basketball Association Fund for the fine.

Also this player must sit down for five rolls of the dice before he can re-enter the game."

"GREAT PLAY: Collect from the Big Money Basketball Association Fund, $100,000 if one of your players has the highest point total in the game."

"Your Superstar Guard has just injured his knee. He will be out for the remainder of the game. The hospital bill and rehabilitation will cost you $160,000."

"Free positioning for your Power Forward. This player can be moved freely before your next move. The ball was just passed to your Power Forward and he rolls towards the hoop and throws up a jump shot. Roll the dice to see if the shot was good. An even roll means the shot was good, and an odd roll means it was not. If shot was not good, roll high dice for control of the rebound. If you win this high dice roll your Power Forward can get this rebound and Slam Dunk it."

"Concession Stand Profit Time!! To find out how much profit you shall collect from this venue. Roll the dice to see how much The Big Money Basketball Association Fund owes you? Roll 2—$200,000; 3$300,000; 4—$400,000; etc . . . "

"Concession Stand Profit Time!! To find out how much profit you shall collect from this venue. Roll the dice to see how much The Big Money Basketball Association Fund owes you? Roll 2—$200,000; 3$300,000; 4—$400,000; etc . . .

This profit will be divided between the home team and the visiting team. The team that has possession gets 60% and the defensive team gets 40%."

"The ball was just passed to your Weak Side Forward and he rolls towards the hoop and throws up a hook shot. Roll the dice to see if the shot was good? An even roll means the shot was good, and an odd roll means it was not. If shot was not good roll high dice for control of the rebound."

"Collect from The Big Money Basketball Association Fund, $300,000 if one of your players the most three (3) point shots in the game."

"Your Superstar Guard has just injured his ankle. He will be out for the remainder of the game. The hospital bill and rehabilitation will cost you $100,000. If you don't have a Superstar Guard pay the Big Money Basketball Association Fund for to enhance one of your Guards potential. It will only cost you $100,000 to make one of your players a Superstar. This change will increase his scoring amounts by $50,000 and his value by $150, 000."

"FAST BREAK!! Your player with the ball goes all the way to the hoop and scores the basket. It's a two (2) point play. Collect $25,000 BONUS, plus whatever is on your player's card from your opponent."

"It's a "Give and Go Play" this works to perfection between two (2) players that you select. Score two (2) points, plus roll the dice (even), and your player was fouled on the play. Roll high dice to see if the Free Throw was good. Collect $50,000 from your opponent for two (2) pointer and $20,000 in addition for the Free Throw, plus whatever is on his Player Contract Card."

"GREAT PLAY: WHAT A PLAY!! Your player with the ball makes a great no look pass. Roll the dice to see who received it? That player will also get two(2) moves, before the defense can react. Roll the dice again to see what he can do."

"CHARGING called on your player with the ball. You must give up the ball and the dice; and pay your opponent $75,000."

"Free positioning for your Power Forward. This player can be moved freely before your next move."

While various embodiments of the application have been described, it will be apparent to those of ordinary skill in the art that many more embodiments and implementations are possible that are within the scope of this invention. For example, the present invention may be used for a board game related to any type of sport having two teams and a ball such as soccer, rugby, football, volleyball, handball, or hockey. Additionally, although the present invention is described using a physical game board, the present invention may also be played as a computer game. Accordingly, the invention is not to be restricted except in light of the attached claims and their equivalents.

I claim:

1. A method of playing a board game comprising:

placing a first set of tokens representative of a first team of sports players on a game board having a portion representative of a sports playing field;

placing a second set of tokens representative of a second team of sports players on the game board;

purchasing, by the first team, at least one player card from a set of player cards, wherein each one of the set of player cards represents at least one characteristic of a sports player;

purchasing, by the second team, at least one player card from the set of player cards;

determining which sports player has possession of a ball;

determining if the sports player with possession of the ball scores; and providing a predetermined amount of money if the sports player with possession of the ball scores to the team that owns a player card corresponding to the sports player that scores;

wherein the predetermined amount of money is specified by the player card corresponding to the sports player that scores.

2. The method of claim 1, wherein a purchase price for each one of the set of player cards is specified on the player card.

3. The method of claim 2, wherein the sports playing field is representative of a basketball court, and wherein the step of determining if the sports player with possession scores includes:

declaring that the sports player will attempt a shot;

checking the player card corresponding to the sports player to determine if the sports player has any characteristics specified on the player card relating to the ability of the sports player to score;

following the instructions on the player card if the player card has characteristics relating to the ability of the sports player to score; and performing a high dice roll if the player card does not have characteristics relating to the ability of the sports player to score.

4. The method of claim 1, further including declaring a winner of the game based on the team with a greater amount of money at the end of the game.

5. The method of claim 1 wherein the step of providing a predetermined amount of money includes transferring the predetermined amount of money from an opposing team to the team that owns the sports player that scores.

6. The method of claim 1 wherein the steps of the method are performed on a computer.

* * * * *